US011043077B2

(12) United States Patent
Nelson et al.

(10) Patent No.: US 11,043,077 B2
(45) Date of Patent: Jun. 22, 2021

(54) PROVIDING TELESTRATOR STYLE INPUTS FOR SPORTS BETTING AND RELATED SYSTEMS AND METHODS

(71) Applicant: IGT, Las Vegas, NV (US)

(72) Inventors: Dwayne Nelson, Las Vegas, NV (US); Patrick Danielson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 50 days.

(21) Appl. No.: 16/384,990

(22) Filed: Apr. 16, 2019

(65) Prior Publication Data

US 2020/0334959 A1 Oct. 22, 2020

(51) Int. Cl.
*G07F 17/32* (2006.01)
*G06Q 50/34* (2012.01)

(52) U.S. Cl.
CPC ..... *G07F 17/3288* (2013.01); *G06Q 50/34* (2013.01); *G07F 17/326* (2013.01); *G07F 17/3209* (2013.01); *G07F 17/3211* (2013.01); *G07F 17/3225* (2013.01); *G07F 17/3244* (2013.01)

(58) Field of Classification Search
CPC ..... G07F 17/3288; G07F 17/3209; G07F 17/3211; G07F 17/3225; G07F 17/3244; G07F 17/326; G06Q 50/34
See application file for complete search history.

(56) References Cited

U.S. PATENT DOCUMENTS 5,762,552 A * 6/1998 Vuong ..... G07F 17/32 463/17
8,690,655 B2 * 4/2014 Meyer ..... A63F 13/537 463/4
2012/0046094 A1 * 2/2012 Shore ..... G07F 17/3288 463/25

* cited by examiner

*Primary Examiner* — Yingchuan Zhang
(74) *Attorney, Agent, or Firm* — Sage Patent Group

(57) ABSTRACT

A gaming system, computer-implemented method and gaming device are provided. A gaming system includes a processor circuit, a memory coupled to the processor circuit. The memory includes machine-readable instructions that cause the processor circuit to provide, to a user, video of a streaming sporting event to a display device of a gaming device. A graphical user interface is generated on the display device and receives inputs from the user that correspond to a wager. A first wager input is received that selects a sporting event component of the wager in the streaming sporting event using the video of the streaming sporting event. A second wager input that identifies an action component of the wager is received. The action component defines a predicted occurrence that the user wagers will occur relative to the sporting event component in a future portion of the streaming sporting event.

18 Claims, 14 Drawing Sheets

PROVIDING TELESTRATOR STYLE INPUTS FOR SPORTS BETTING AND RELATED SYSTEMS AND METHODS

BACKGROUND

Embodiments described herein relate to providing opportunities for betting on events. Events, such as sporting events have many aspects that make them attractive to spectators, both from an entertainment standpoint and a wagering and/or betting standpoint. Sporting events may be viewed in person, e.g., in a sports venue such as ballpark or stadium, or remotely, e.g., in a casino or other environment, via a television or other video display. As technology improves and as the competition for the attention of bettors and spectators increases, there is a need for additional interactive features that increase spectator involvement and excitement.

SUMMARY

According to some embodiments, a gaming system includes a processor circuit and a memory coupled to the processor circuit. The memory includes machine-readable instructions that, when executed by the processor circuit, cause the processor circuit to provide video of a streaming sporting event to a display device of a gaming device, generate a graphical user interface on the display device that receives an input that corresponds to a wager, receive, via the graphical user interface, a first wager input that selects a sporting event component of the wager in the streaming sporting event using the video of the streaming sporting event, and receive, via the graphical user interface, a second wager input that identifies an action component of the wager, wherein the action component corresponds to a predicted occurrence that a user wagers will occur relative to the sporting event component in a future portion of the streaming sporting event.

Some embodiments are directed to a computer-implemented method of operating a gaming device. Operations according to such methods include providing, to a user and via a display device of the gaming device, a video that corresponds to a streaming sporting event, providing, to the user and via the display device, multiple wager input graphics that correspond to the streaming sporting event and that each, when actuated by the user, corresponds to a wager input that is receivable by the gaming device, and receiving, into the gaming device, the wager input that causes a wager to be placed based on an outcome in the streaming sporting event that occurs in a subsequently occurring play session.

Some embodiments are directed to a gaming device that includes a display device, a processor circuit, and a memory coupled to the processor circuit. The memory includes machine-readable instructions that, when executed by the processor circuit, cause the processor circuit to provide, to a user, video of a streaming sporting event to the display device, generate a graphical user interface on the display device, wherein the graphical user interface receives inputs from the user that correspond to a wager, receive, via the graphical user interface, a wager input that selects a sporting event outcome corresponding to a predicted occurrence in the streaming sporting event and that is received via a pointer graphical input element, and generate multiple action options that correspond to sporting event outcome options that are selectable by the user.

DETAILED DESCRIPTION

Figure 1:
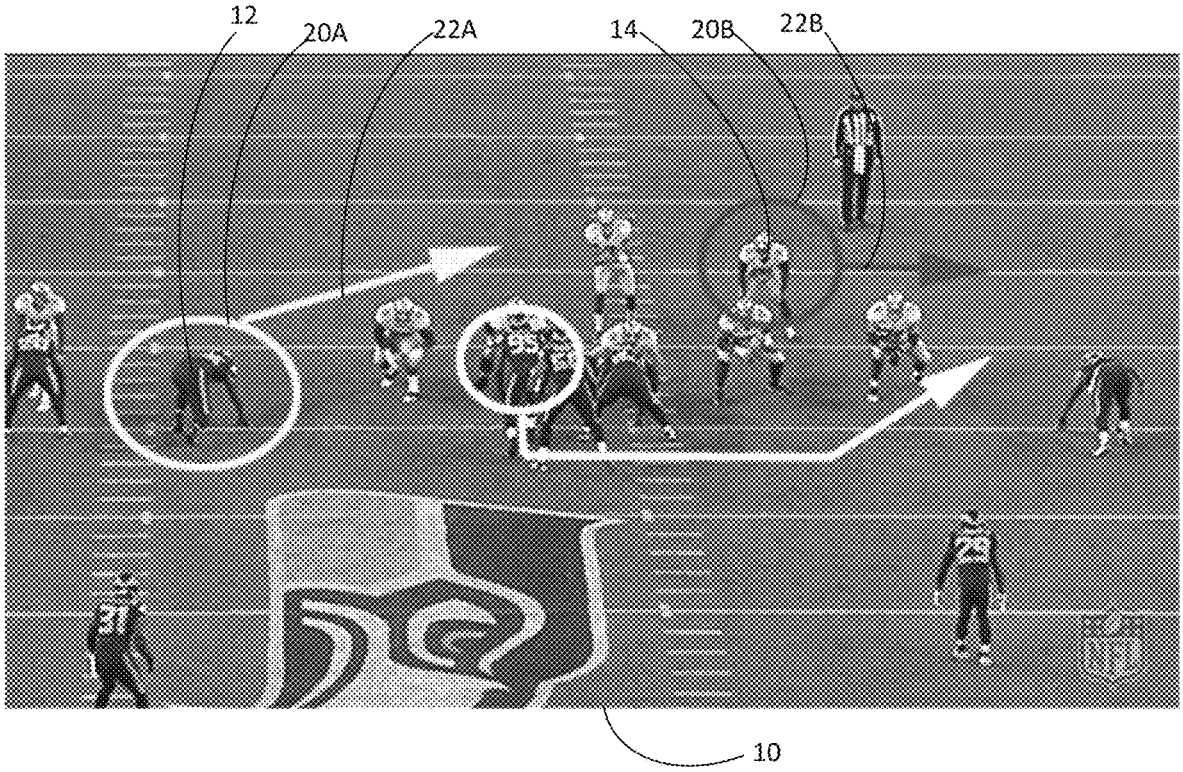
FIG. 1 is a screenshot of a video of a streaming sporting event with telestrator inputs according to some embodiments.

Embodiments herein are directed to various systems, devices and methods for sports betting that use graphical user input techniques, such as telestrator and/or similar techniques, for placing a sports wager on a live sporting event during the live sporting event. Specifically, embodiments herein provide a user interface that is a technical solution that addresses the problem corresponding to the amount of time it takes to define and place a wager on specific outcomes occurring during a live sporting event.

As used herein, the term "telestrator" may refer to a device that allows its operator to draw a freehand sketch over a still or moving video image. The telestrator may overlay the sketch on the video image to generate a combined image for broadcast or display. In some embodiments, the freehand sketch may provide inputs for defining and/or placing a wager on a particular portion of the live sporting event. For example, in a sporting event that experiences routine stops and starts of plays, such as American football, the particular portion may correspond to the next play or a given number of plays. In a sporting event that is substantially uninterrupted, such as soccer or hockey, the particular portion may correspond to a predefined period of play time and/or time on the play clock.

In some embodiments, the sporting event may include fighting based competitions between individuals and/or teams. Such fighting based competitions may include martial arts, mixed martial arts (MMA), boxing, and/or wrestling, among others.

Some embodiments provide that, the user uses the graphical user interface to define inputs corresponding to a wager. In this manner, the telestrator allows the user to make a bet on a particular play in a game. The inputs may include an identification of sporting event participant and an action that the sporting event participant is expected to take from the perspective of the user. The sporting event participant may include a specific player and/or may include a team or portion thereof that may be identified graphically using the telestrator. In some embodiments, once the sporting event participant is selected by the user, the user may be presented with multiple different predicted actions that the sporting event participant will take during the subsequent portion of the sporting event. For example, the user may want to wager that a certain NFL athlete will run the ball to the right on the next down. According to embodiments herein, the user may simply touch an athlete on the screen (by name or position) and then draw with their finger or other pointing device on the screen to the right from the specific player to place a bet that the selected player will run right. This may provide a simple, quick and natural way to place sports wagers.

Embodiments disclosed herein may be performed using a gaming device to perform sports betting. As used herein, a gaming device may include mobile devices, personal computers, kiosks and/or sports betting terminals, among others. The in-play sports bet is a real time bet in which the user predicts the actions of the team or team member or the result of the team in the near future such as the next down, next service, next possession and/or next turn. The user can wager real money, virtual money and/or points.

Although several examples discussed herein may be directed to American football, the present inventive concept applies to any sport and/or type thereof. Embodiments herein may simplify in-play (real time) sports betting by allowing the player to make a natural action such as touching the image of the player on the screen. Furthermore, the player can swipe her/his finger to a selected side and draw a line on the screen indicating the direction the user expects the sporting event participant to move.

Reference is now made to FIG. 1, which is a screenshot of a video of a streaming sporting event with telestrator inputs according to some embodiments. In some embodiments, the streaming sporting event may include a live sporting event. Some embodiments provide that the streaming sporting event includes a virtual sporting event that simulates a sporting event by known and/or unknown teams and/or event participants.

For example, the streaming sporting event video 10 may display an image of the teams and/or sporting event participants. Using a graphical user interface that provides the telestrator function, a first wager input 20A that selects a specific sporting event participant 12 may be identified by the user. The user may then submit an action 22A that corresponds to the sporting event participant 12 as a second wager input using the graphical user interface.

In some embodiments, the sporting event participant 12 may be a player on a team and/or a team or individual participant in a sporting competition. For example, the user may define inputs that correspond to a wager that the football player 12 identified in the first wager input 20A will move in a direction generally defined by the arrow that provides the second wager input 22A. Although not illustrated in the current figure, a confirmation input may be received that confirms that the player is wagering that the sporting event participant 20A will move in the identified direction 22A during the next play. The confirmation input may be a portion identified on the display device, a double tap of the graphics corresponding to the first and/or second wager inputs and/or a button on a controller and/or on the gaming device.

In some embodiments, the first wager input may be inherently provided by virtue of the second wager input. Continuing with the football example, the action corresponding to the second wager input may be only applicable to a specific sporting event participant. For example, an action selecting the input as advancing the ball at least X yards down the field in the next play would only be applicable to the team having possession of the ball. In such embodiments, the first wager input is inherently selected as whichever team has possession of the football.

As provided, the user may place more than one bet per play. For example, the user may define inputs that correspond to a wager that the football player 14 identified in the first wager input 20B will move in a direction generally defined by the arrow that provides the second input 22B. Although not illustrated in the current figure, a confirmation input may be received that confirms that the player is wagering that the sporting event participant 20B will move in the identified direction 22B during the next play. In some embodiments, different wagers may be graphically represented using different colors. Some embodiments provide that different wagering amounts may be graphically represented using different colors.

Figure 2:
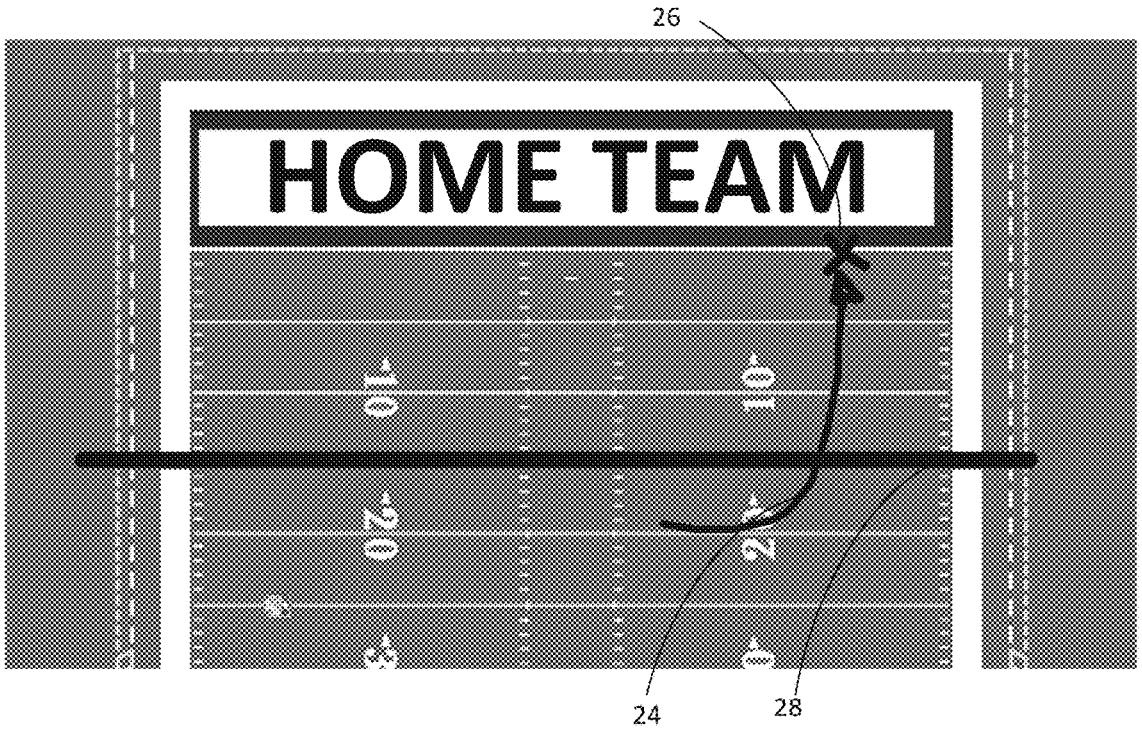
FIG. 2 is a schematic view of a screen shot of a sporting event playing surface of a streaming sporting event with telestrator inputs according to some embodiments.

Furthermore, the player might draw an "X", "O" or another marker on the screen to further customize the bet. For example, the "O" might correspond to bet that the athlete will run to the given location, which the "X" indicates that the athlete will receive a pass at the location. FIG. 2 is a schematic view of a sporting event playing surface of a streaming sporting event with telestrator inputs according to some embodiments that shows an example of the player placing a bet by swiping to the right and drawing an "X". As illustrated, based on the swipe to the right, the inputs received are that the player will go to the right and past the line of scrimmage 28 and the "X" may indicate that a pass will be received.

Figure 3:
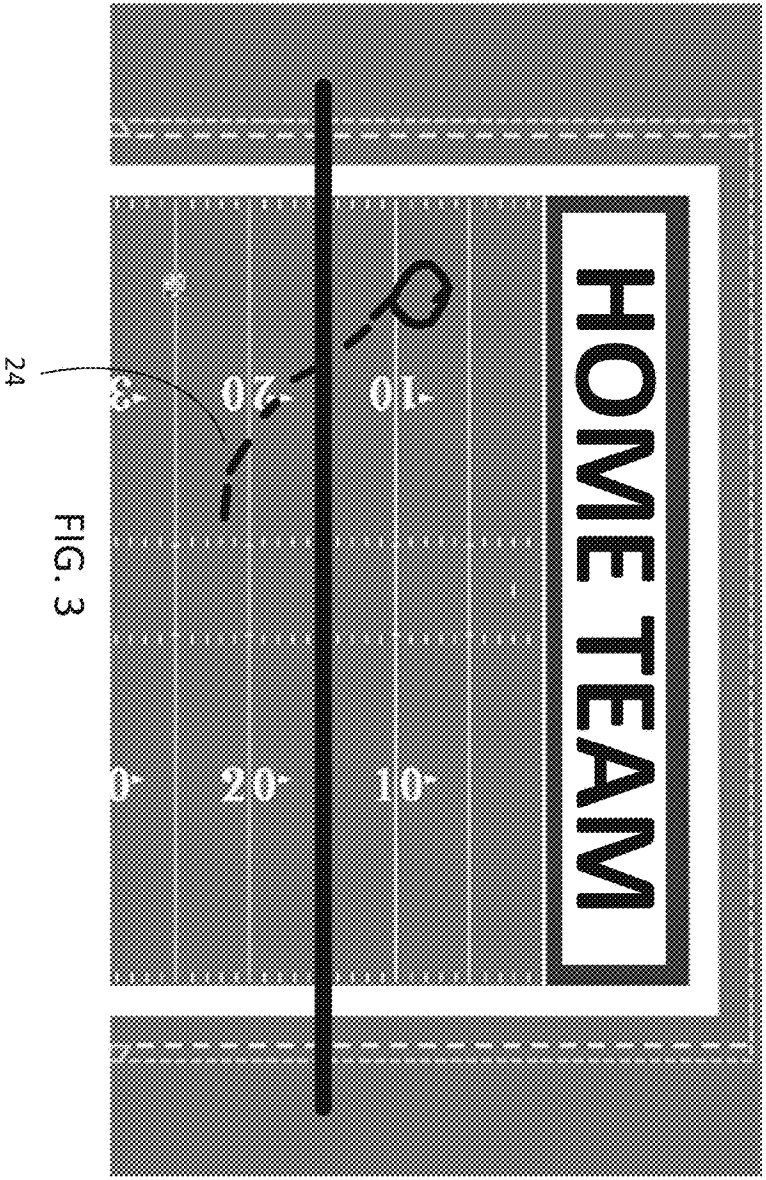
FIG. 3 is a schematic view of a screen shot of a sporting event playing surface of a streaming sporting event with telestrator inputs according to some embodiments.

Brief reference is now made to FIG. 3, which is a schematic view of a sporting event playing surface of a streaming sporting event with modified telestrator inputs according to some embodiments. In some embodiments, a line drawn by the player using the telestrator input may distinguish between different types of bets and/or actions. For example, the player may draw a solid line and/or a dotted line that may or may not end in an arrow. Each of the different types and variations of lines may further define a detail corresponding to the wager. For example, a line with an arrow could indicate a completed pass while no arrow indicates an incomplete pass. In some embodiments, a dotted line may indicate an incomplete pass in the direction corresponding to the line.

Figure 4:
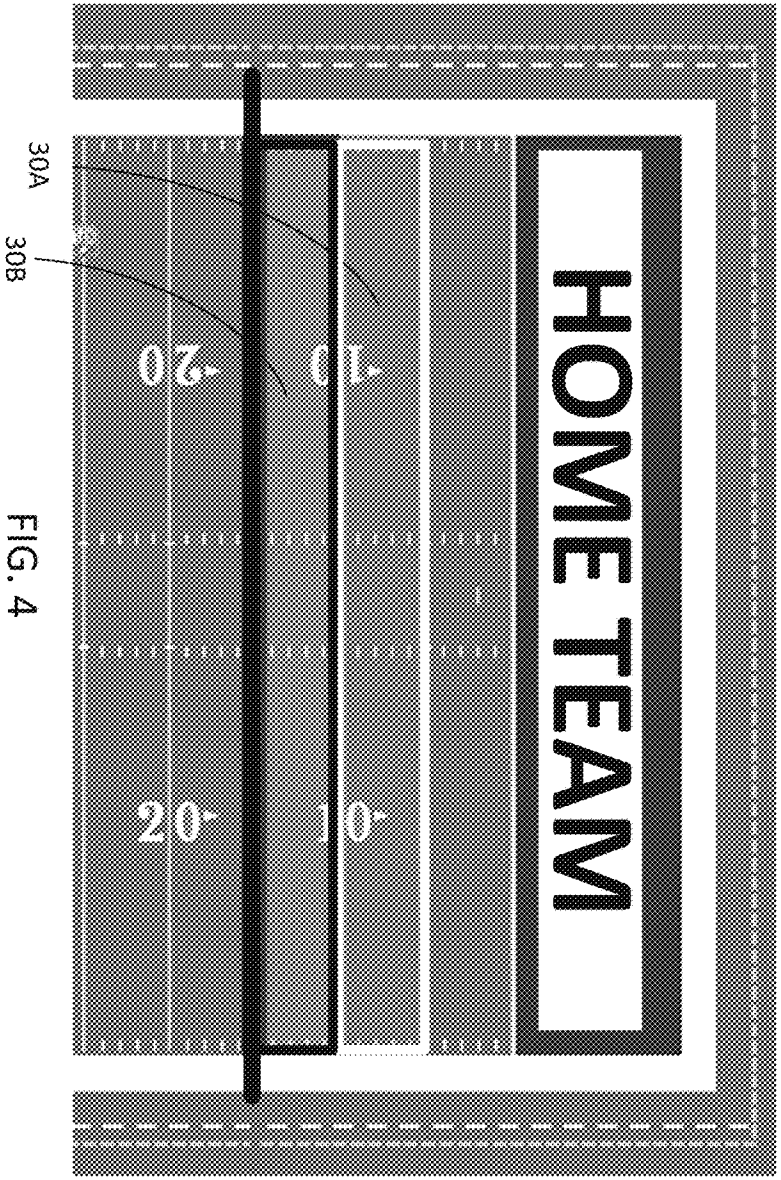
FIG. 4 is a schematic view of a screen shot of a sporting event playing surface of a streaming sporting event with telestrator inputs according to some embodiments that uses regions to define wager inputs.

Brief reference is now made to FIG. 4, which is a schematic view of a sporting event playing surface of a streaming sporting event with modified telestrator inputs according to some embodiments that uses regions to define wager inputs. These regions 30 may indicate to the player that there are two betting opportunities. The first region 30B may indicate advancing 1 to 5 yards, while the second region 30A may indicate advancing 6 to 10 yards. In some embodiments, the graphical user interface may further include text that describe the definitions of the two wagering opportunities. In some embodiments, the player may draw and/or drop in to regions to place a wager. For example, the player might draw a line ending in the orange region indicating a bet that the team will advance 6 to 10 yards.

In some embodiments, the player may define a line and/or a combination of lines by touching starting and ending points of one or more line segments. For example, the player might touch 3 or more points and form a path including two connected line segments.

In some embodiments, the color of the pen the player uses to draw lines may provide an additional input. For example, a blue line may represent a run while a red line may represent a pass.

Figure 5:
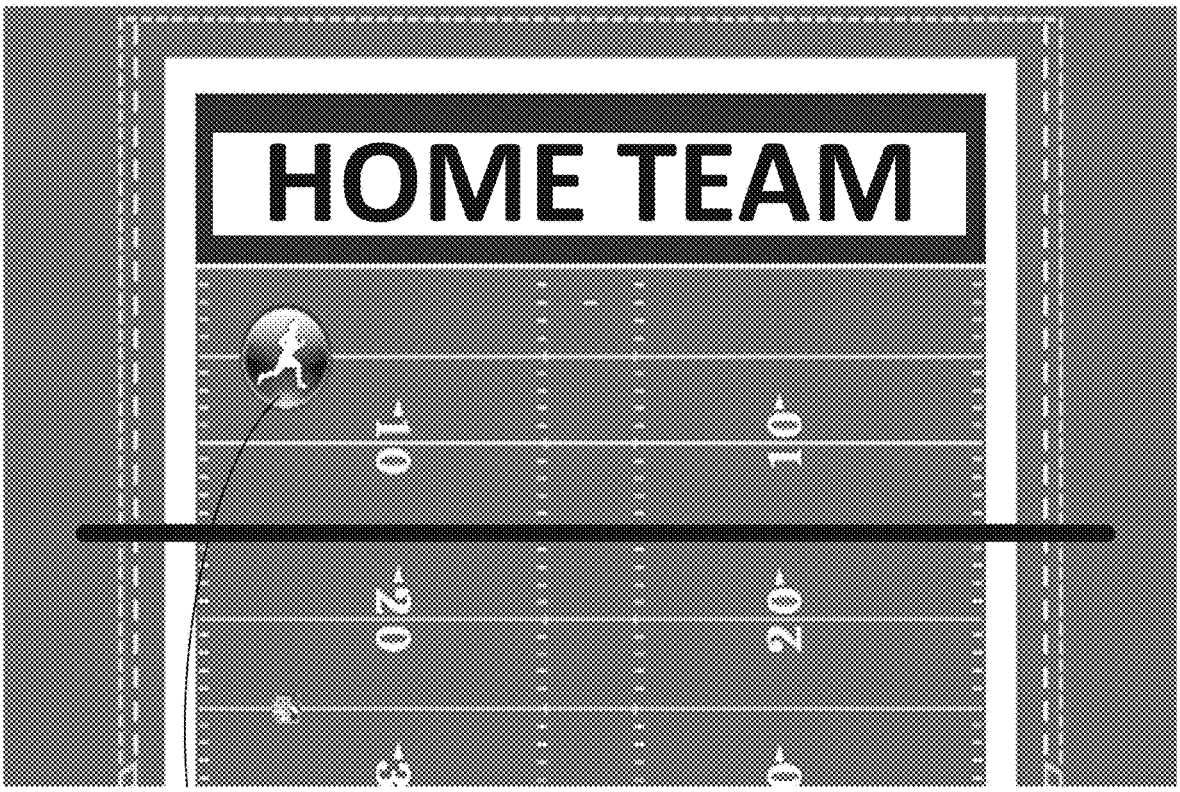
FIG. 5 is a schematic view of a screen shot of a sporting event playing surface of a streaming sporting event with telestrator inputs according to some embodiments that uses a symbol or graphic to define a wager input.

Reference is now made to FIG. 5, which is a schematic view of a sporting event playing surface of a streaming sporting event with modified telestrator inputs according to some embodiments that uses a symbol or graphic to define a wager input. In some embodiments, the player might draw and drop icons 34 onto the image of the sports field to place a bet. For example, the player might drag a RUN icon 34 onto the field and place it 5 yards ahead of the line of scrimmage to place a bet that the team will run for 5 yards on the next play. This is shown in FIG. 5 where the RUN icon 34 is placed approximately 10 yards from the line of scrimmage.

The icon 34 could mean that the player must land near the place of the icon 34. For example, FIG. 5 may define a wager that the play is a run that ends within 3 yards of the place run icon location. Some wager inputs do not define a specific location. For these wagers, the player may simply drag the icon 34 onto the field to wager. For example, the player may wager that there is a foul or a fumble on the next play. In such embodiments, the player may drag a foul or fumble icon 34 onto the field and place it anywhere place the wager.

Figure 6:
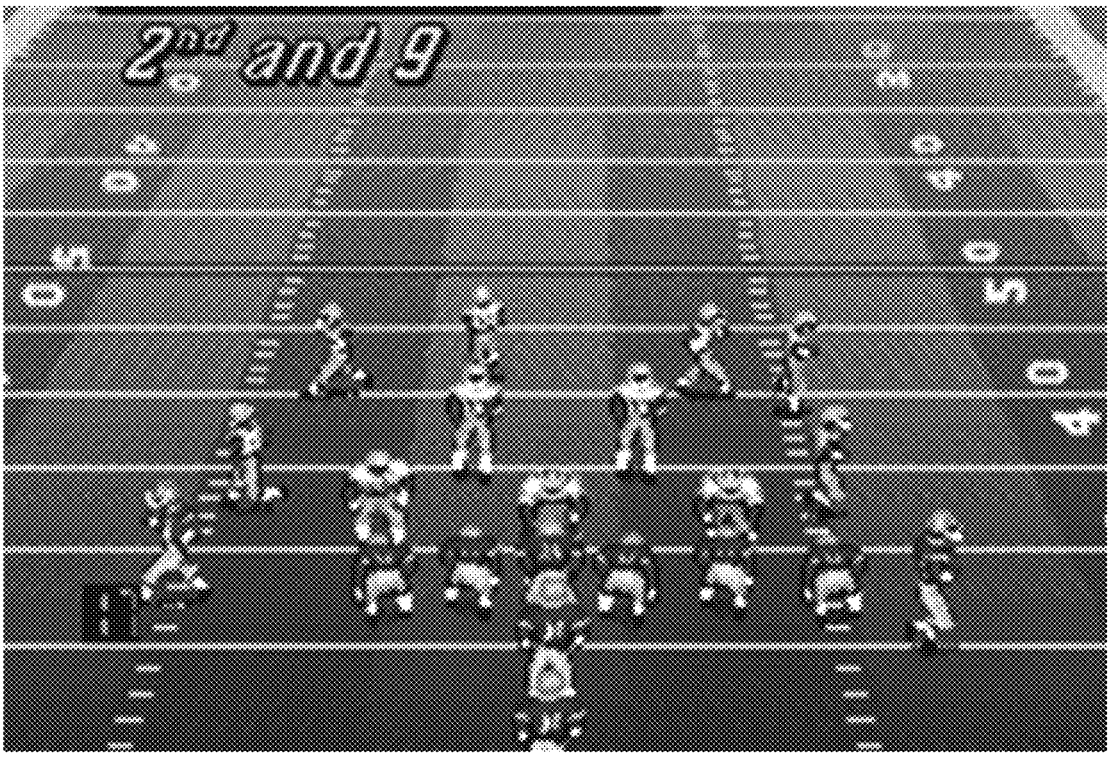
FIG. 6 is a schematic view of a virtual sporting event playing surface of a virtual sporting event that is capable of receiving telestrator inputs as wager inputs according to some embodiments herein.

As provided above, the streaming sporting event may include a live streamed sporting event. However, some embodiments provide that the streaming sporting event may be a graphically produced sporting event that include representations of sporting event participants and the corresponding environment. For example, a sporting event may be a virtual sporting event in which the play between real or virtual teams is determined by a rule-based game simulation engine that includes random processes for determining the play of the virtual sporting event. Some embodiments provide that the virtual sporting events may correspond to the outcomes in real sporting events. Brief reference is made to FIG. 6, which is a schematic view of a virtual sporting event playing surface of a virtual sporting event that is capable of receiving telestrator inputs as wager inputs according to some embodiments herein.

In some embodiments, virtual and/or real athletes are shown on the screen for the player to choose and/or draw actions using telestrator inputs. Some embodiments provide that individual athletes can be grayed out of otherwise visually disabled to indicate that the athlete is not available for in-play wagering. Player unavailability may be based on the state of the game, among other reasons. For example, during a field goal attempt, the players might not be eligible for passing. Some embodiments provide that players may be unavailable for wagering due to the odds-making system not allowing the particular wager because it is not wagerable for some reason, such as, for example, when the action is a guaranteed action or there aren't enough players to make a wagering pool for the action.

In some embodiments the player might be able to make multiple wagers in real time. For example, the player might wager that the team passes the ball and the quarterback is sacked. In another example the player might wager that the team will pass to the right and that the pass will be intercepted.

Figure 7:
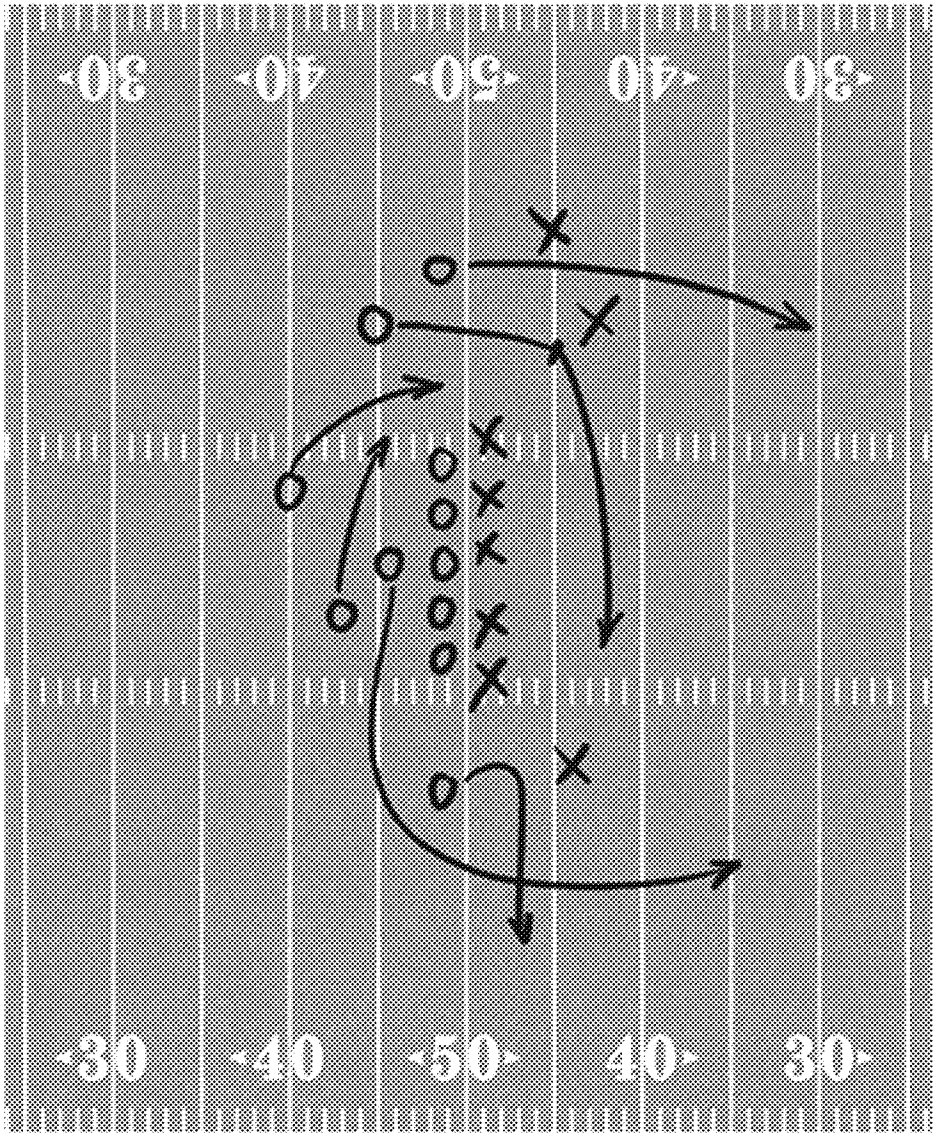
FIG. 7 is a schematic view of a virtual sporting event playing surface of a virtual sporting event that is capable of receiving telestrator inputs that define combinations of participant movements as wager inputs according to some embodiments herein.
Figure 8A:
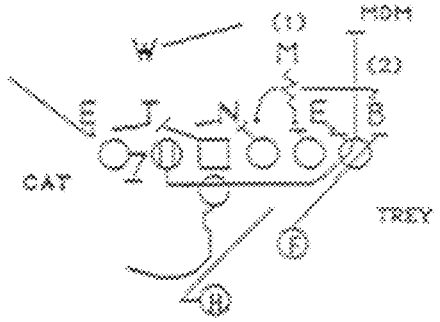
FIGS. 8A-8D are schematic illustrations of different plays that may be selected from a play repository according to some embodiments herein.
Figure 8B:
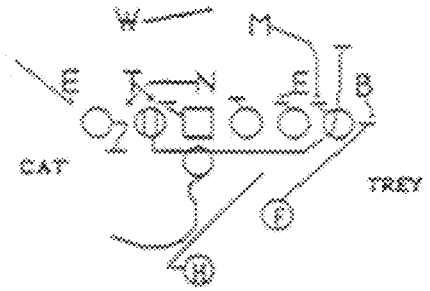
Figure 8C:
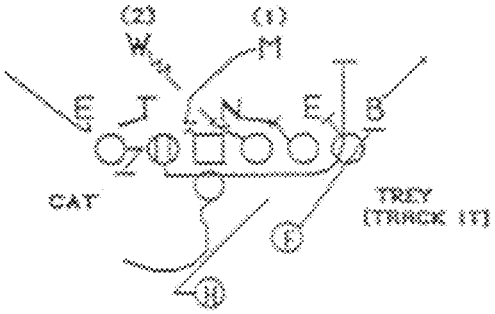
Figure 8D:
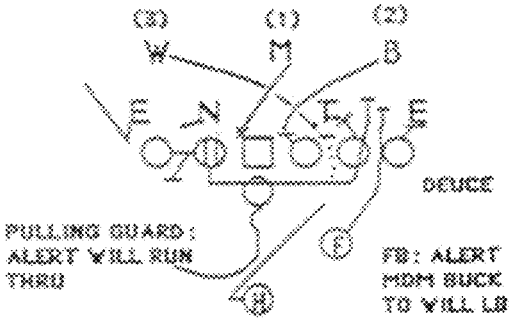

Brief reference is now made to FIG. 7, which is a schematic view of a virtual sporting event playing surface of a virtual sporting event that is capable of receiving telestrator inputs that define combinations of participant movements as wager inputs according to some embodiments herein. In some embodiments, the player may place wagers by drawing combinations of participant movements that may represent plays on the virtual sporting event playing surface. In such embodiments, the player may be wagering that a team will execute a specific play. In such events, the sporting event participant may be the team that is selected to make the specific play. Some embodiments provide that the wager outcome may be determined by the percentage of elements in the combination that were executed according to the predicted play.

Some embodiments provide that the plays are selected from a play repository. For example, brief reference is now made to FIGS. 8A-8D, which are schematic illustrations of different plays that may be selected from a play repository according to some embodiments herein. In some embodiments, the player can select a common play and wager that the team will perform the action corresponding to the selected play. In this manner, the wager may be simple, such as a wager input that defines "run for 5 yards," and/or be complex such as selecting one of the plays shown in FIGS. 8A-8D.

Figure 9:
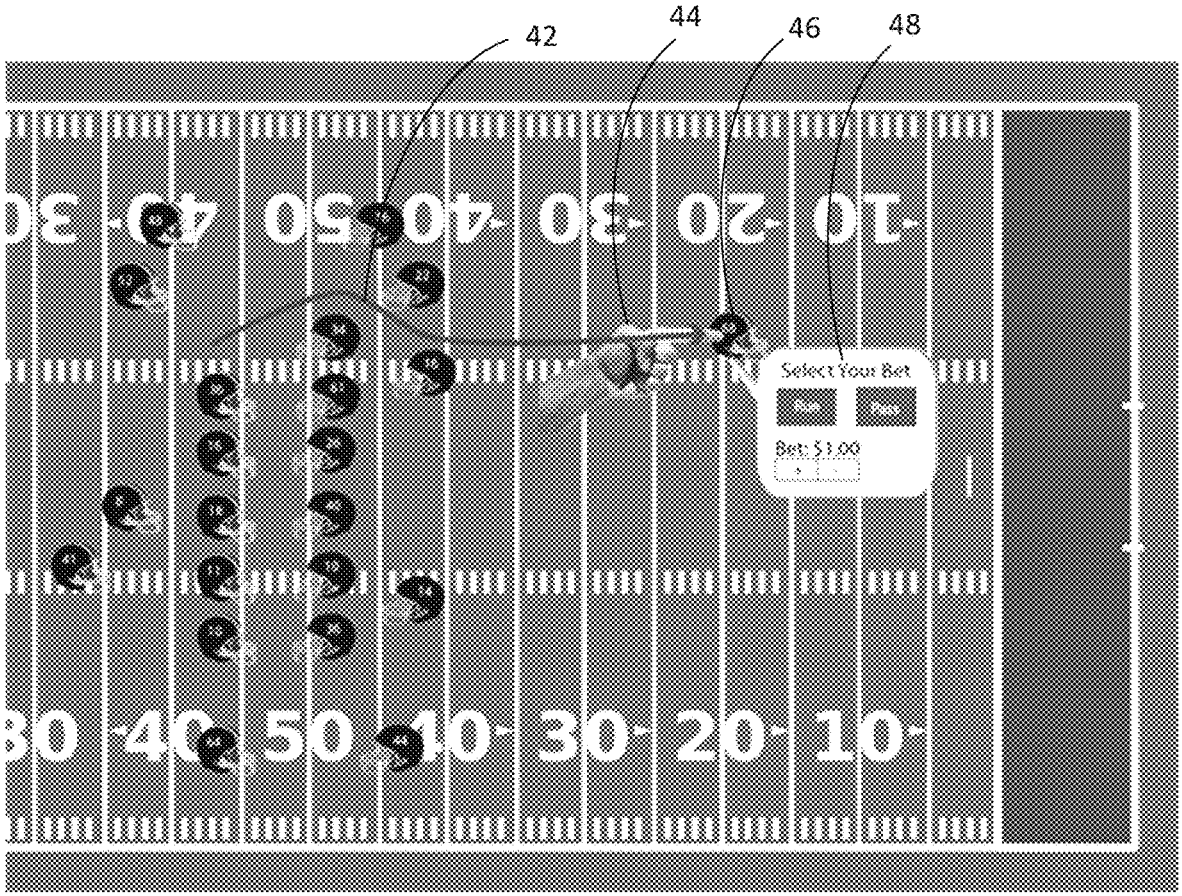
FIG. 9 is a schematic illustration of a screen-shot that illustrates a telestrator input in which a player can predict which sporting event participant will receive the ball to allow them to play a run or pass bet on a live game according to some embodiments.

Reference is now made to FIG. 9, which is a schematic illustration of a screen-shot that illustrates a telestrator input in which a player can predict which sporting event participant will receive the ball to allow them to play a run or pass bet on a live game. In some embodiments, the telestrator input 42 is received via a gesture input 44 from the player in which the player touches and drags the sporting event participant 46 to the place on the playfield that the player predicts that the play will take place. In some embodiments, a pop-up window 48 may be displayed to demonstrate the options to finalize a wager. Such options may include the type of play, such as, run or pass, and the wager amount, among others.

In the context of a fighting-based competition, the telestrator input may correspond to a particular fighter and define a particular action, such as kick, punch, takedown, and/or tap out, among others. In some embodiments, the time interval for the predicted action to occur may be a given time interval and/or may correspond to rounds in the fighting-based competition.

In some embodiments, the wager and odds may be determined by the accuracy of the prediction along with the end results of a particular play. For example, a player among multiple players may correctly guess that the team will run to the left for 5 yards, but the player that drew the most accurate path that matched the outcome of the play may be awarded an additional award, such as a progressive or pool award. Some embodiments provide that the accuracy of the telestrator input may determine and/or alter the payout amount corresponding to a winning wager.

For tracking a wagering game player in a casino or other wagering venue, some embodiments herein may further include real-time or substantially real-time player tracking functions to keep track of the player wagering data and/or positions during the live streaming event. For example, since a wagering session may include many wagers that are placed and resolved in a very short period of time, data may be continuously and/or periodically updated to include data regarding number of wins/losses, amount won/lost, and/or a balance of funds available for subsequent wagering, among others. In some embodiments, the player data and/or positions may be provided to a central server that may be in communication with a gaming device.

In some embodiments, the player may initially set an in-play wager amount. Once the wager amount is set, all subsequent wagers during that wagering session may be of that amount. For example, the player may set the in-play wager amount at $2.00. On the next down the player selects the wide receiver and draws a passing play to place a $2.00 bet that the selected wide receiver will receive the ball on the next play in the manner drawn by the player. By being able to set the in-play wager amount prior to defining the wager inputs, time establishing the wager may be reduced and having to re-enter the wager amount at each play may be eliminated.

In some embodiments, the player may draw a circle (or other enclosed region) where the player wagers and wagering activity will occur. For example, the player might draw a circle in the end zone to indicate that a reception will happen within the enclosed region. In this type of wager, the first wager input that selects the team is inherently selected based on the predicted outcome of the play.

In some embodiments, much like the number selection through keno, duplicate wagers may be placed when they are compatible with the recognizable play. In some embodiments, the player may cycle through a predetermined set of wagers, either regularly, or as part as an assist mechanism to guide the player toward the basic wagering opportunities.

As disclosed herein, types of wagering events that may apply in a football context may include run, pass, a particular direction of action, number of yards gained or lost, location of a reception or tackle, fumble, sack, foul, block, touchdown, field goal, and/or player or position making the action, among others. While discussed herein in detail with respect to football, embodiments herein may be applied to other sports, such as, for example, basketball. Examples of wagering events that may apply in basketball may include score or attempt 2 point, score or attempt 3 point shot, location where shot is taken, dunk, pass, screen, pick and roll, foul, and/or player or position making the action, among others.

Further, streaming sporting events as disclosed herein may include live sporting events such as professional sporting events, amateur and/or collegiate sporting events among others. Sporting events may include any team sport or contest and/or any individual sport or contest. Sports may include any sports corresponding to balls, pucks, stones, swords, cards, dice, trivia knowledge, tracks, hurdles, javelins, rackets, firearms, bows, and/or weights, among others. Streaming sporting events may include virtual sporting events in which real or virtual sporting participants are depicted in a virtually presented event and/or contest. Outcomes of such virtual sporting events may be determined by rule-based operation of the sporting event that may include random determinations regarding in-play outcomes.

Embodiments described herein relate to providing video of streaming sporting events at video gaming devices, and in particular to providing streaming sporting events with telestrator type wager inputs for in-play wagering on streaming sporting events at gaming devices, and related systems and methods.

Figure 10:
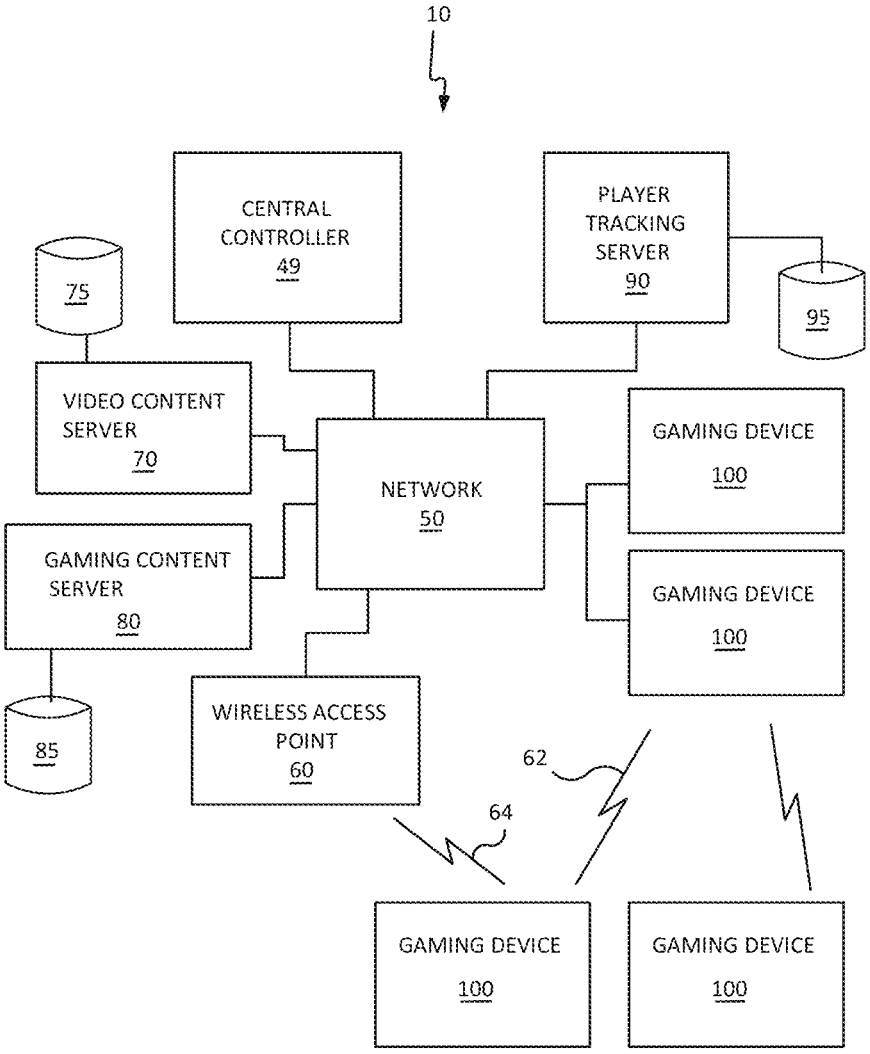
FIG. 10 is a schematic block diagram illustrating a system including a plurality of gaming devices according to some embodiments herein.

In this regard, FIG. 10 illustrates a system 10 including a plurality of gaming devices 100. The system 10 may be located, for example, on the premises of a gaming establishment, such as a casino, in a private residence, or may include components that are located at different locations. The gaming devices 100 may be in communication with each other and/or a central controller 49 through a data communication network 50, or remote communication link. The data communication network 50 may be a private data communication network that is operated, for example, by the gaming facility that operates the gaming device 100, a publicly accessible data communication network such as the Internet, or a combination thereof. Communications over the data communication network 50 may be encrypted for security. The central controller 40 may be any suitable server or computing device which includes at least one processing circuit, such as a processor, and at least one memory or storage device. Each gaming device 100 may include a processing circuit that transmits and receives events, messages, commands or any other suitable data or signal between the gaming device 100 and the central controller 49 and/or other gaming devices 100. The gaming device processor is operable to execute such communicated events, messages or commands in conjunction with the operation of the gaming device 100. Moreover, the processor of the central controller 49 is configured to transmit and receive events, messages, commands or any other suitable data or signal between the central controller 49 and each of the individual gaming devices 100. In some embodiments, one or more of the functions of the central controller 49 may be performed by one or more gaming device processors. Moreover, in some embodiments, one or more of the functions of one or more gaming device processors as disclosed herein may be performed by the central controller 49.

A wireless access point 60 provides wireless access to the data communication network 50. The wireless access point 60 may be connected to the data communication network 50 as illustrated in FIG. 10, or may be connected directly to the central controller 49 or another server connected to the data communication network 50.

One or more content servers, such as a video content server 70 and a gaming content server 80, may also be connected through the data communication network 50. The video content server 70 may manage delivery of the streaming video content to a user of a gaming device 100. The streaming video content may be stored in a video content database 75. Similarly, the gaming content server 80 may manage delivery of the gaming content to the user of a gaming device 100. The gaming content may be stored in a gaming content database 85. The video content server 70 and a gaming content server 80 may be implemented within or separately from each other. The video content server 70 and a gaming content server 80 may also be implemented within or separately from the central controller 40.

A player tracking server 90 may also be connected through the data communication network 50. The player tracking server 90 may manage a player tracking account that tracks the gameplay and spending and/or other player preferences and customizations of a player, i.e., the user of the gaming device 100, manages loyalty awards for the player, manages funds deposited or advanced on behalf of the player, and other functions. Player information managed by the player tracking server 90 may be stored in a player information database 95.

The gaming devices 100 communicate with one or more elements of the system 10 to coordinate providing streaming video content and synchronized gaming content. For example, in some embodiments, a gaming device 100 may communicate directly with another gaming device 100 over a wireless interface 62, which may be a WiFi link, a Bluetooth link, an NFC link, etc. In other embodiments, the gaming device 100 may communicate with the data communication network 50 (and devices connected thereto, including EGMs) over a wireless interface 64 with the wireless access point 160. The wireless interface 64 may include a WiFi link, a Bluetooth link, an NFC link, etc. In still further embodiments, the gaming device 100 may communicate with other gaming devices 100 or other devices over the wireless interface 62 and the wireless access point 60 over the wireless interface 64. In these embodiments, the wireless interface 62 and the wireless interface 64 may use different communication protocols and/or different communication resources, such as different frequencies, time slots, spreading codes, etc. For example, in some embodiments, the wireless interface 62 may be a Bluetooth link, while the wireless interface 64 may be a WiFi link.

The wireless interfaces 62, 64 allow the gaming devices 100 and/or central controller 40 to coordinate providing streaming video content and synchronized gaming content to the gaming devices 100.

In some embodiments, the central controller 40, video content server 70 and/or gaming content server 80 may coordinate the generation and display of the streaming video content and the synchronized gaming content to more than one user and/or to more than one gaming device 100. As described in more detail below, this may enable multiple users to interact with the same streaming video content and/or gaming content in real time. This feature can be used to provide a shared multiplayer experience to multiple users at the same time. Moreover, in some embodiments, the central controller 40, video content server 70 and/or gaming content server 80 may coordinate the generation and display of the streaming video content and the synchronized gaming content to users at different physical locations.

Figure 11:
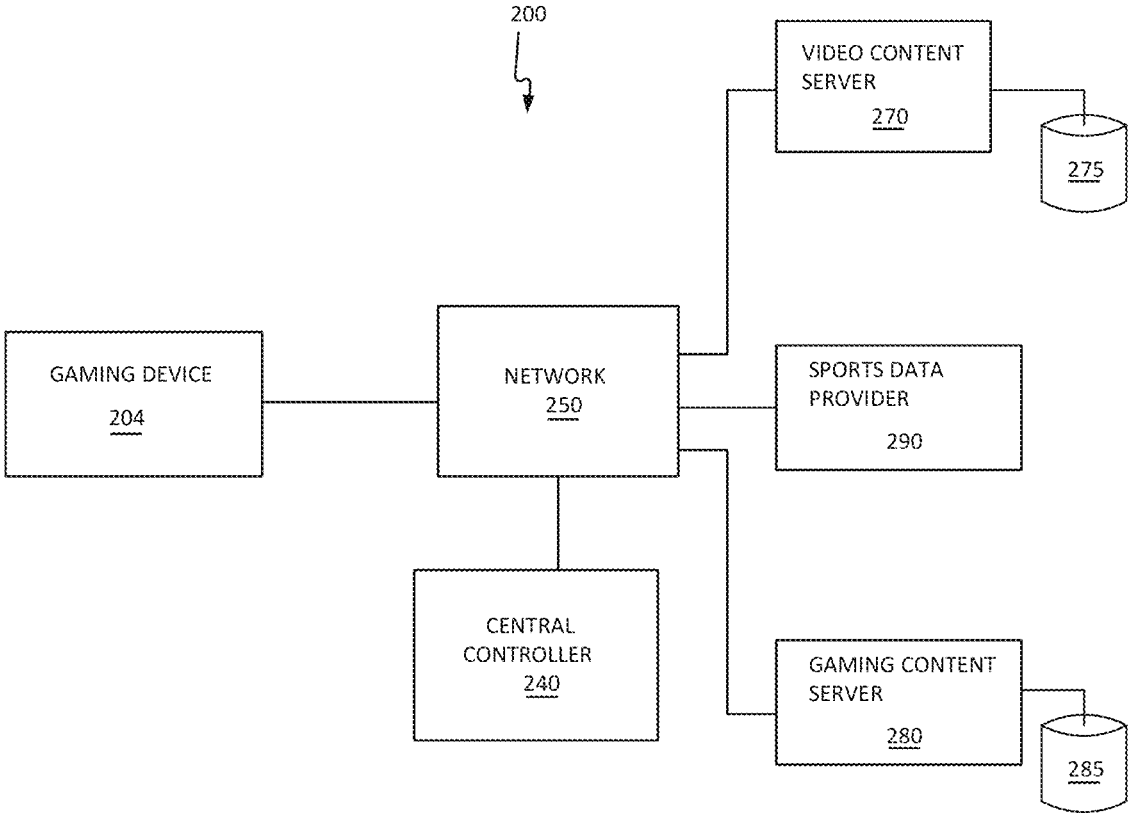
FIG. 11 is a schematic block diagram illustrating a network configuration including a streaming video content server, a gaming content server providing video of a streaming sporting event and in-play wagering using telestrator inputs according to some embodiments.

Referring now to FIG. 11, a schematic block diagram illustrating network configurations for a system 200 including a video content server 270 and a gaming content server 280 is illustrated. The system 200 may include a gaming device 204 and a central controller 240 for providing streaming video content and gaming content to a user via the gaming device 204. In this example, the gaming device 204 is connected to the central controller 240 via a network 250, but it should be understood that the central controller 240 in some embodiments may be part of the gaming device 204 or may be connected to the gaming device 204 via a direct wired or wireless connection as well. A video content server 270 and a gaming content server 280 are also connected to the central controller 240 via the network 250 in this example.

In some embodiments, a sports data provider 290 may evaluate the outcomes of events related to in-play wagers and provide an indication regarding the outcome of the wagers. In some embodiments, the sports data provider 290 may provide a set of results corresponding to given events in the sports games. For example, in the context of football, a set of results may include data corresponding to run, pass, number of yards lost or gained, player number, play type correlation, line of scrimmage, and/or occurrences such as fumble, foul, interception, and/or scoring, among others. Any of the gaming device 204, the central controller 240, and the gaming content server 280 may use the sports data from the sports data provider to resolve the outcomes of in-play wagers.

Figure 12:
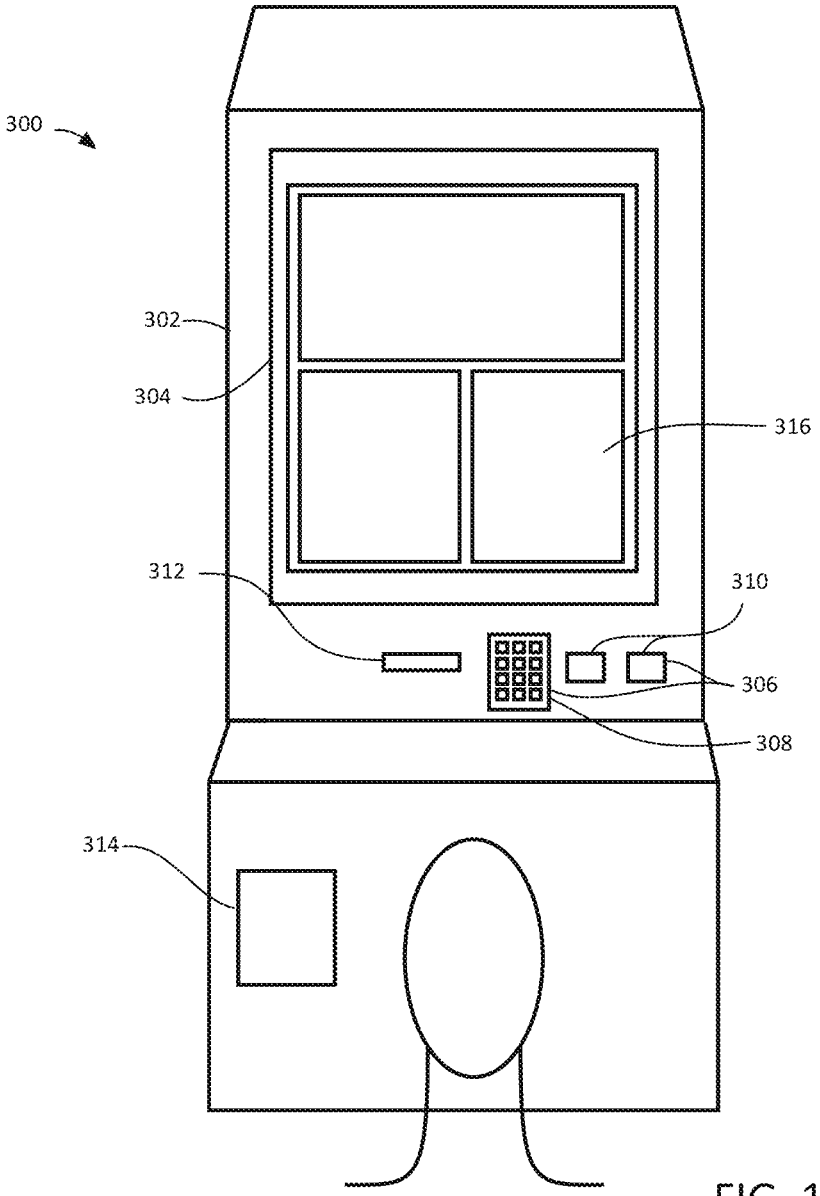
FIG. 12 illustrates a gaming terminal for providing video of a live sporting event and in-play wagering using telestrator inputs according to some embodiments.

As used herein, a gaming device may include, for example, an electronic gaming device such as an electronic gaming machine (EGM), gaming terminal, etc., an electromechanical gaming device, a computing device such as a personal computer, a mobile computing device such as a tablet, smartphone, etc., or another device or devices. In this regard, FIG. 12 illustrates a dedicated gaming terminal 300 for providing video of a live sporting event and in-play wagering using telestrator inputs according to some embodiments. In some embodiments, the gaming terminal 300 includes a housing 302 having a display device 304, and a plurality of input devices 306, such as a keypad 308, buttons 310, etc., for receiving user input for playing the wagering game and otherwise interacting with the gaming terminal 300. In some embodiments, the display device 304 may include a touchscreen interface for receiving user input as well. The display device 304 may also be a single display device or may include multiple display devices, such as a first display device for displaying video of the live sporting event and a second display device for displaying gaming and wagering information for example. The gaming terminal 300 may include additional specialized hardware as well, such as an acceptor 312, for receiving currency (i.e., bills and/or coins), tokens, credit or debit cards, or other physical items associated with monetary or other value. The gaming terminal 300 may also include a dispenser 314, for dispensing items, such as physical items having monetary or other value (e.g., awards or prizes) or other items.

As will be discussed in detail below, the gaming terminal 300 may include a processor circuit and a memory coupled to the processor circuit. The memory may include machine-readable instructions that, when executed by the processor circuit, cause the processor circuit to perform operations for operating the gaming terminal 300 and/or other features described herein. In this example, the gaming terminal 300 may include a graphical user interface (GUI) 316 displayed by the display device 304 for providing the video and gaming information to the player.

Figure 13:
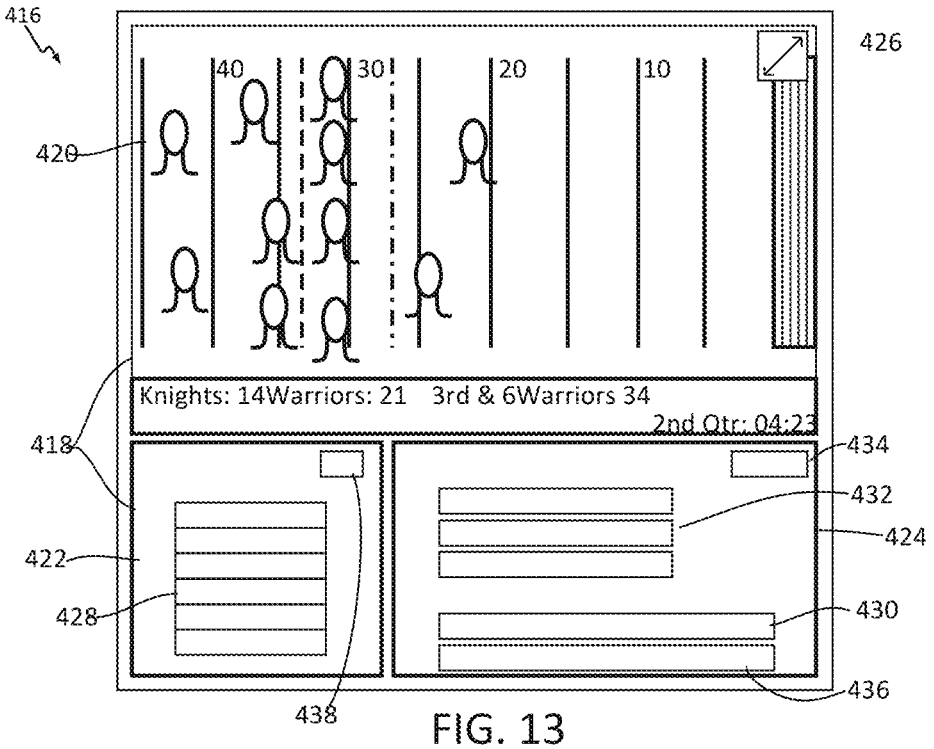
FIG. 13 is a diagram of a graphical user interface for a gaming device including video of a live sporting event and telestrator inputs displayed on a display of a gaming terminal, according to some embodiments.

In this regard, FIG. 13 is a diagram of a GUI 416 for a gaming device including video of a live sporting event and in-play wagering inputs displayed on a display of a gaming terminal, according to some embodiments. In this example, as shown by FIG. 13, the GUI 416 may be partitioned into different display areas 418, including a live video area 420, a wager selection area 422, and a control interface area 424. It should be understood, however, that additional features may be provided by the GUI 416, such as multiple live video windows, a casino gaming betting interface area, social game interface area, and/or a service window area, for example, as desired.

The live video area 420 may provide video of the live sporting event. In some examples, live video area 420 may be resizable to take up a larger or smaller portion of the display area of the GUI 416. For example, the player may select a full screen toggle option 426 that causes the live video area 420 to enter a full screen mode that fills the entire display area of the GUI 416. The player may manually exit the full screen mode to view and/or place wagers by re-selecting the full screen toggle option 426. In some examples, the full screen mode may also be subject to a time limit that automatically exits the full screen mode after a predetermined amount of time, for example, to encourage the player to place additional wagers.

Some embodiments provide that settings corresponding to the telestrator inputs may be made in a wage selection area 422, after which, the telestrator inputs may be drawn directly on the live video area 420. The wager selection area 422 may include a plurality of telestrator input wagers 428, some or all of which may correspond to the live sporting event being displayed in the live video area 420.

The control interface area 424 may include a search function 430 that may allow a user to search for particular wagers using a plurality of different criteria, such as additional wager types, sporting event participants, and/or available wagers. The control interface area 424 may also provide a user with the option 432 to select a different game to watch, and may provide additional information, such as a current time 434 and/or a time at which games are scheduled to begin 436, for example. The wager selection area 422 may also update its display of available bets in real time or near real time as new bets (such as betting on the next play or the next player) or updated bets become available.

It should be appreciated that there are thousands of possible sports wagers at any given time, and that these and other user interfaces may be customized to allow a user to access desired content more quickly and efficiently. For example, a user may scroll through a list of sports, then through a list of games, and then through a list of bets associated with a selected game. Likewise, there may be many live video channels and/or sporting events available, which can be accessed in a similar manner. In some embodiments, a user may select a live video channel and/or sporting event, and the user interface may update based on the selection to present a selection of wagers relating to the sporting event, sport, hometown, player preferences, etc.

The GUI 416 or other user interface may be configured in additional ways as well. For example, the GUI 416 may include a timeout function 438 that gives the user a predetermined amount of time to place a wager before the wager is unavailable. In some embodiments, wagers may be limited to wagers on the live sporting or other event being watched.

Figure 14:
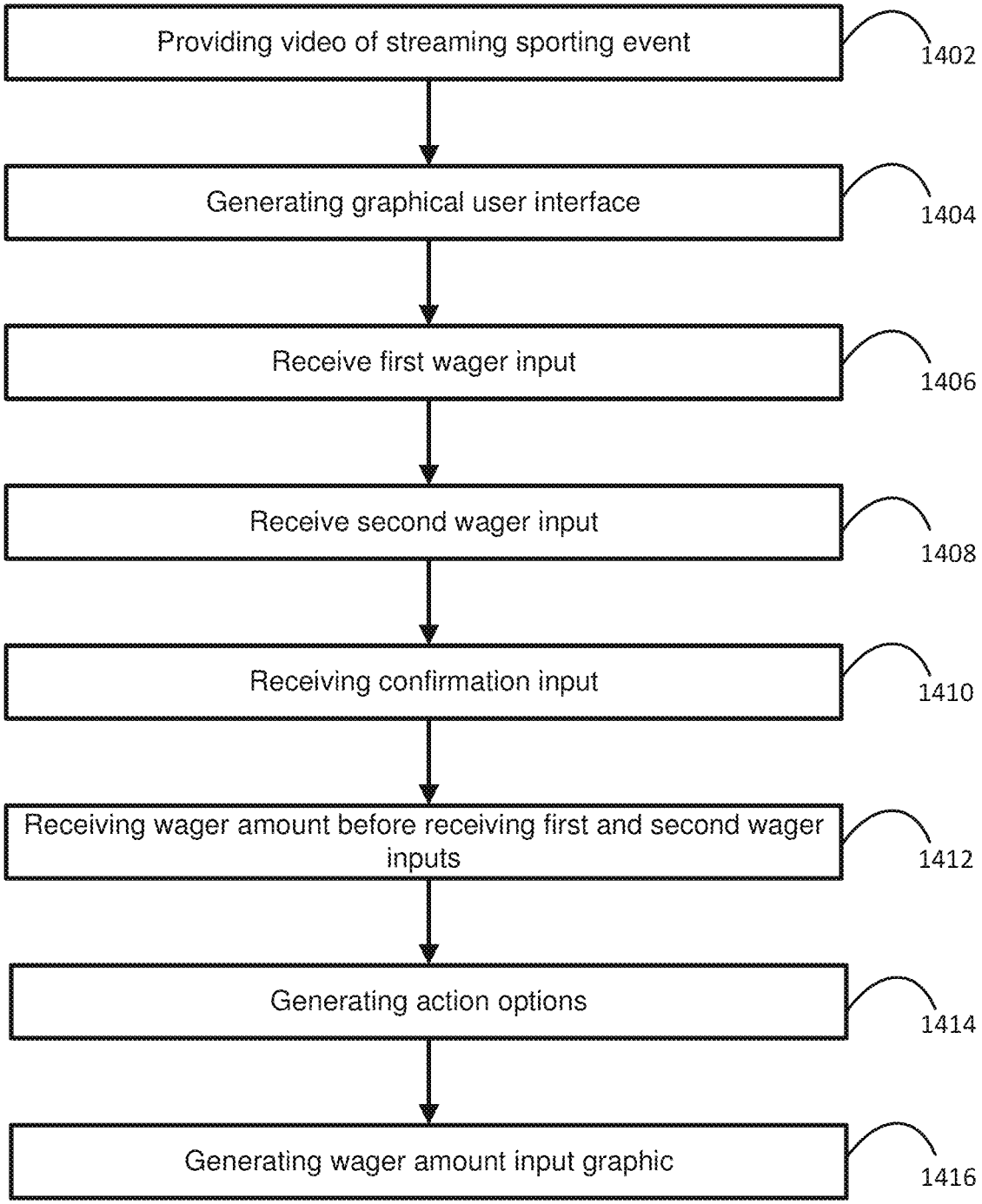
FIG. 14 is a flowchart illustrating operations of systems/methods according to some embodiments.

These and other features may be implemented as operations that may be executed by a processor circuit of a computing device. Reference is now made to FIG. 14, which is a flowchart illustrating operations of systems/methods according to some embodiments. Operations may include providing a video of a streaming sporting event to a display device of a gaming device (block 1402). As provided above the streaming sporting event may include a real sporting event between one or more sporting event participants and/or a virtual sporting event that is generated. A sporting event as used herein may include any type of event and/or contest that may provide opportunities for in-play wagering using a telestrator input.

A graphical interface may be generated on a display device of a gaming device (block 1404). The graphical interface may receive an input that corresponds to a wager via a telestrator. The telestrator input may be provided by providing a graphical input that may be received by and/or visible on the video on the display device. Some embodiments provide that the graphical input is received via a player's finger using a touchscreen display. Other embodiments provide that the graphical input may be received via a pointing device, such as a mouse, trackball, joystick, stylus and/or contactless gesture, among others.

Operations include receiving, via the graphical user interface, a first wager input that selects a sporting event component of the wager in the streaming sporting event using the video of the streaming sporting event (block 1406). In some embodiments, the graphical user interface includes a sporting event participant selection graphic that is movable relative to the streaming sporting event that is displayed and that is movable to select the sporting event component to provide the first wager input. Some embodiments provide that the sporting event component is a player on a team participating in the streaming sporting event.

Operations include receiving, via the graphical user interface, a second wager input that identifies an action component of the wager (block 1408). In some embodiments, the action component corresponds to a predicted occurrence that a user wagers will occur relative to the sporting event component in a future portion of the streaming sporting event. The future portion of the game may include a next play, a next quantity of plays, a time interval and/or a play interval that is defined by an occurrence in the streaming sporting event. For example, in the context of football, an interval may be defined by a given team having uninterrupted possession of the ball before scoring or turning the ball over to the other team.

Some embodiments provide that a confirmation input that corresponds to the wager is received (block 1410). Such embodiments may provide that a wager that is defined by the first wager input and the second wager input and that includes an outcome based on the streaming sporting event is received in response to receiving the confirmation input.

In some embodiments, the wager includes a wager amount that is received before the first and second wager inputs are received (block 1412). In some embodiments, the wager amount may be set by the player and may apply to all subsequently occurring in-play wagers that are received during the wagering session or until an updated wager amount is received.

Some embodiments provide that the second wager input includes a directional graphic that defines, via the graphical user interface, a predicted direction of movement of a player during a subsequent play session. In some embodiments, each team participating in the streaming sporting event includes multiple players and less than all of the players are selectable as the sporting event component. For example, certain players and/or player positions may not be available to be selected as a wager input. The graphical user interface may depict this unavailability by shading or graying out such the unavailable players.

In some embodiments, the graphical user interface includes a sporting event component graphic that is movable to identify a play position on a sporting event play surface in the streaming sporting event. A sporting event component graphic may include an icon that represents a given play outcome, such as a run, pass reception, fumble, interception, etc. The first wager input includes the sporting event component graphic and the second wager input includes the play position that is identified by a location of the sporting event component graphic.

Some embodiments provide that each team participating in the streaming sporting event includes multiple players and that the graphical user interface includes a sporting event component graphic that displays combinations of player movements that may represent multiple different plays that define predicted actions of at least a portion of the of players. For example, some embodiments provide that the first wager input includes a selection of a given team in the sporting event and the second wager input includes a selection of one of the plays.

In some embodiments, in response to receiving the first wager input, the processor circuit graphically generates multiple action options for selection by the user as the second wager input (block 1414). For example, a player may select a given sporting event participant as a first wager input. In response to this selection, multiple different action options may be presented to the player via the graphical user interface that are specific to the selected sporting event participant.

In some embodiments, in response to receiving the first wager input, the processor circuit graphically generates a wager amount input graphic that is selectable by the user to provide a wager amount input (block 1416). For example, responsive to receiving the first and/or second wager inputs, a menu may be displayed that is operative to receive a wager amount input corresponding to the wager.

In some embodiments, the sporting event component of the first wager input includes a player on a sports team in the streaming sporting event and the action component of the second wager input includes a direction of player movement during a subsequent play session. Some embodiments provide that the sporting event component of the first wager input includes a player on a sports team in the streaming sporting event and the action component of the second wager input includes a prediction of a region of the displayed playing surface, such as the playing field, that the selected player will advance to.

In some embodiments, the sporting event component of the first wager input includes team field position and the action component of the second wager input includes a range of distance that the team field position will change during a given number of subsequent plays. Some embodiments provide that receiving the first wager input includes receiving a graphical pointer input via the graphical user interface. In some embodiments, the first wager input includes one of multiple available colors. Each color may correspond to a different specific action that the user wagers that a selected sporting event participant will take.

Figure 15:
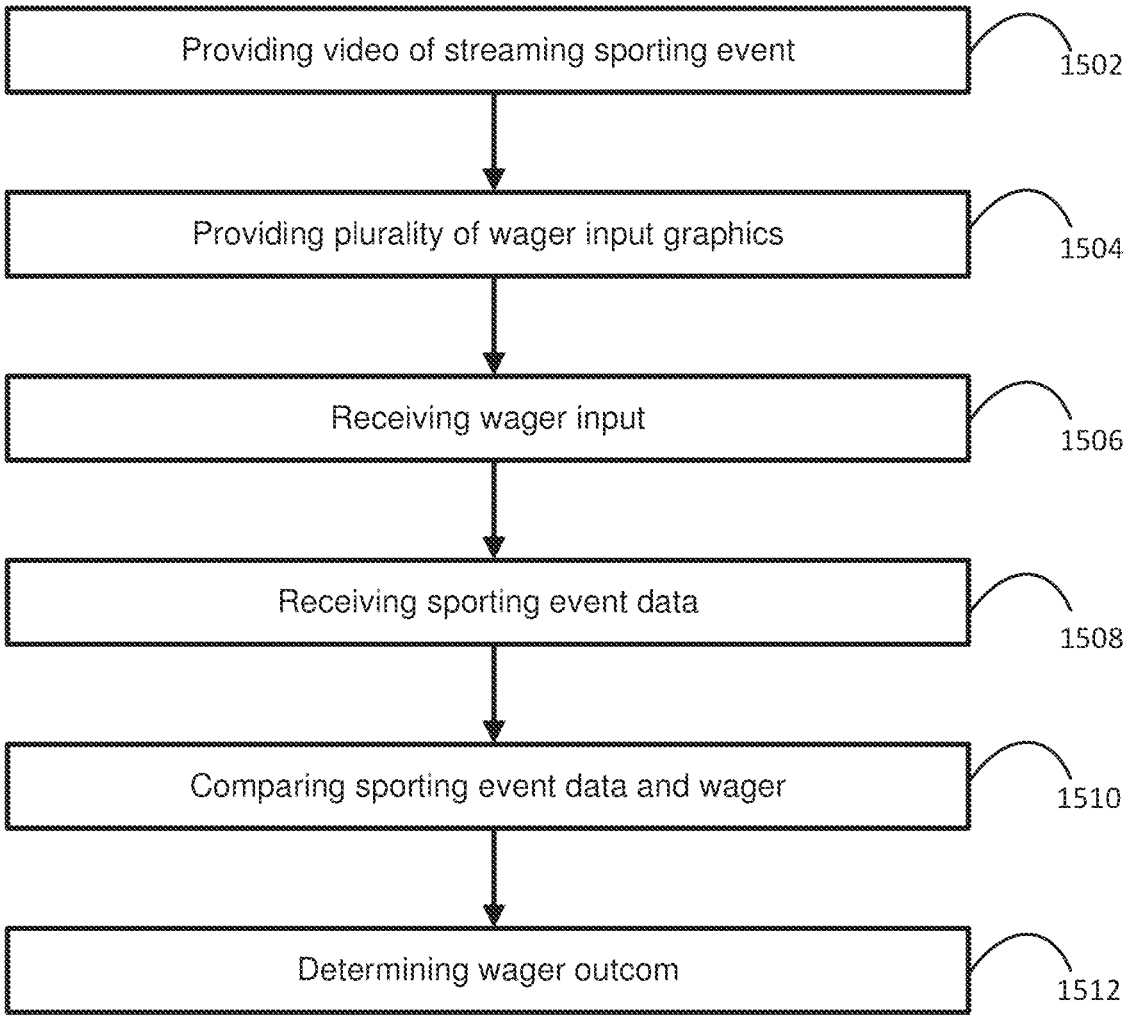
FIG. 15 is a flowchart illustrating operations of systems/methods according to some embodiments.

Reference is now made to FIG. 15, which is a flowchart illustrating operations of systems/methods according to some embodiments. Operations include providing, to a user and via a display device of a gaming device, a video that corresponds to a streaming sporting event (block 1502). Operations further include providing, to the user and via the display device, multiple wager input graphics (block 1504). The wager input graphics may correspond to the streaming sporting event. Each of the wagering input graphics, when actuated by the user, corresponds to a wager input that is receivable by the gaming device. Operations include receiving, into the gaming device, the wager input that causes a wager to be placed (block 1506). The wager may be based on an outcome in the streaming sporting event that occurs in a subsequently occurring play session.

In some embodiments, the wager input graphics includes multiple different icons that each are associated with a different predicted result in the subsequently occurring play session. Some embodiments provide that the user actuates a selected wager input graphic by moving the selected wager input graphic to an image of a field of play for the streaming sporting event. In some embodiments, the wager input includes a first wager input and a second wager input. Some embodiments provide that which one of the input graphics that is selected is the first wager input. The second wager input includes a location on the image of the field of play for the streaming sporting event.

In some embodiments, providing the video that corresponds to the streaming sporting event includes generating multiple virtual images of multiple sporting event participants. Some embodiments provide that the wager input includes a first wager input and a second wager input. The first wager input may be a selected one of the sporting event participants that is selected by selecting a corresponding one of the virtual images. The second wager input may include an action that the selected one of the sporting event participants is predicted to perform during a subsequent play session in the streaming sporting event.

In some embodiments, operations include receiving, from a data provider, sporting event data that corresponds to portions of the streaming sporting event (block 1508). Some embodiments provide that the sporting event data includes data regarding the outcome in the streaming sporting event that occurs in the subsequently occurring play session. Operations may include comparing the wager with the sporting event data regarding the outcome in the streaming sporting event (block 1510) and, responsive to the comparing, determining a wager outcome of the wager (block 1512).

Figure 16:
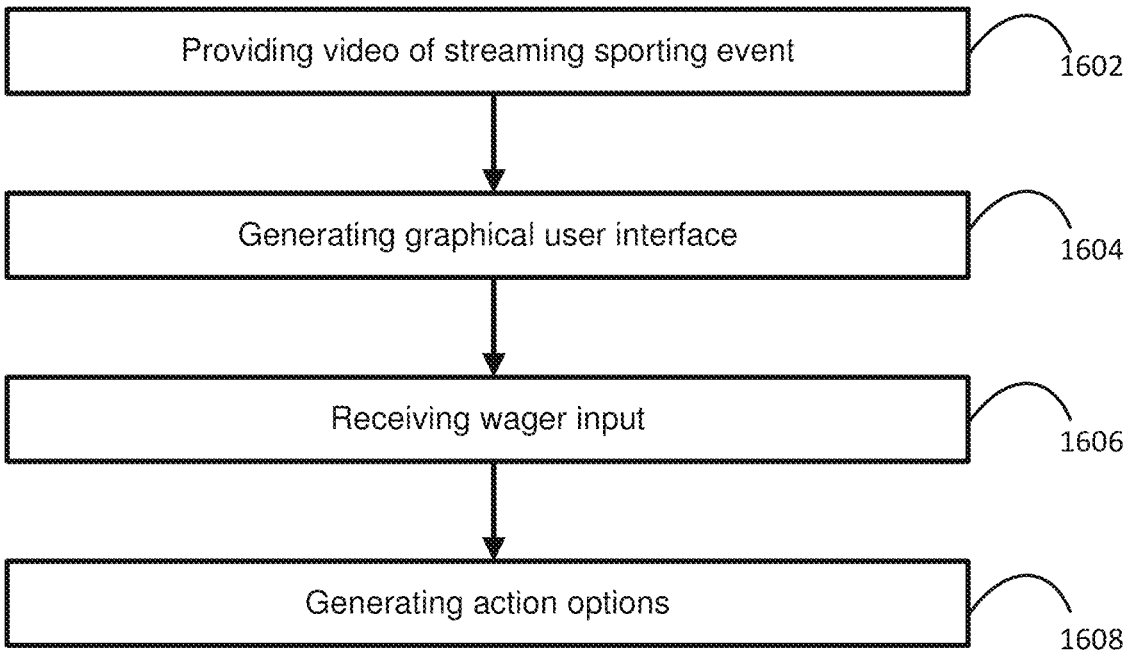
FIG. 16 is a flowchart illustrating operations of systems/methods according to some embodiments.

Reference is now made to FIG. 16, which is a flowchart illustrating operations of systems/methods according to some embodiments. Operation include providing, to a user, video of a streaming sporting event to a display device (block 1602) and generating, a graphical user interface on the display device (block 1604). In some embodiments, the graphical user interface receives inputs from the user that correspond to a wager. Operations include receiving, via the graphical user interface, a wager input that selects a sporting event outcome (block 1606). The selected sporting event outcome corresponds to a predicted occurrence in the streaming sporting event and may be received via a pointer graphical input element. Operations include generating multiple action options that correspond to sporting event outcome options that are selectable by the user (block 1608).

Figure 17:
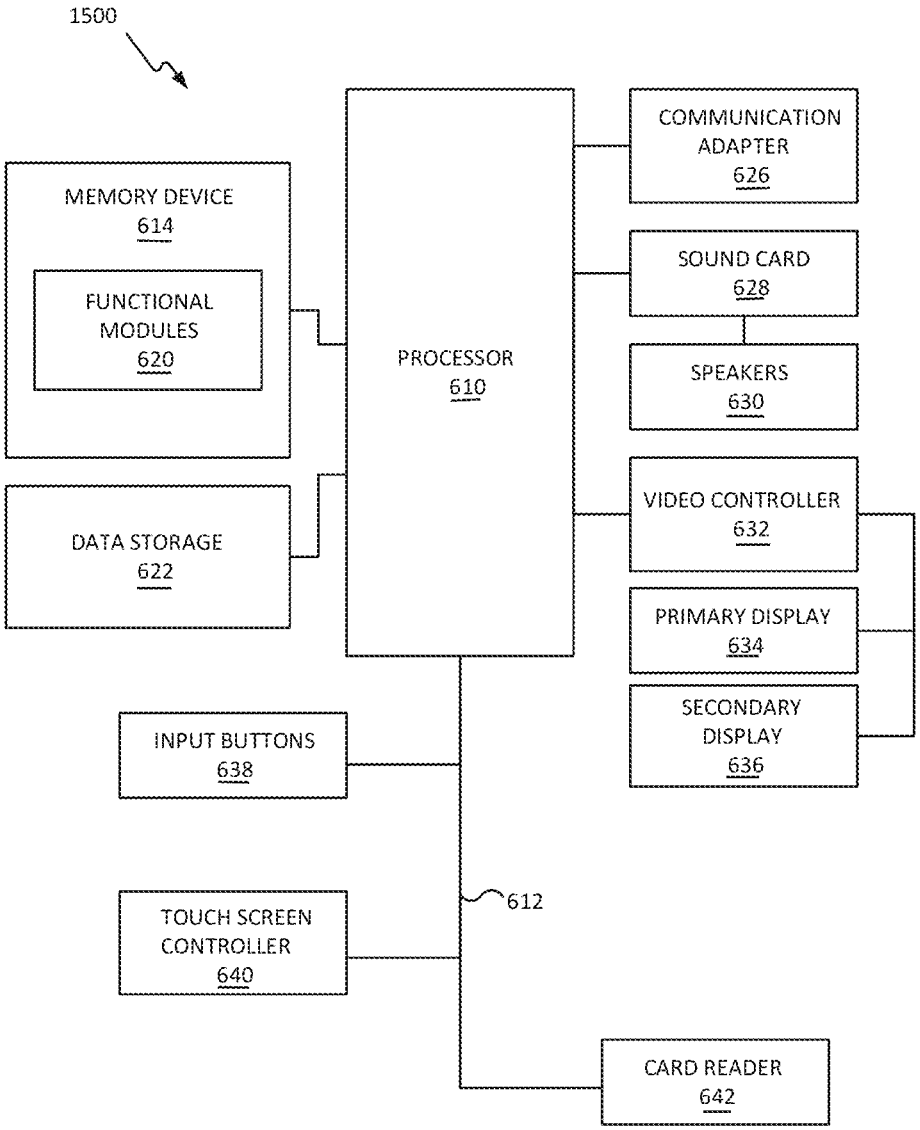
FIG. 17 is a schematic block diagram illustrating various components of a computing device according to some embodiments.

Referring now to FIG. 17, a block diagram that illustrates various components of a computing device 1500, which may embody or be included as part of the devices, systems, and/or components above, according to some embodiments. As shown in FIG. 17, the computing device 1500 may include a processor circuit 610 that controls operations of the computing device 1500. Although illustrated as a single processor, multiple special purpose and/or general-purpose processors and/or processor cores may be provided in the computing device 1500. For example, the computing device 1500 may include one or more of a video processor, a signal processor, a sound processor and/or a communication controller that performs one or more control functions within the computing device 1500. The processor circuit 610 may be variously referred to as a "controller," "microcontroller," "microprocessor" or simply a "computer." The processor circuit 610 may further include one or more application-specific integrated circuits (ASICs).

Various components of the computing device 1500 are illustrated in FIG. 17 as being connected to the processor circuit 610. It will be appreciated that the components may be connected to the processor circuit 610 and/or each other through one or more busses 612 including a system bus, a communication bus and controller, such as a USB controller and USB bus, a network interface, or any other suitable type of connection.

The computing device 1500 further includes a memory device 614 that stores one or more functional modules 620 for performing the operations described above. Alternatively, or in addition, some of the operations described above may be performed by other devices connected to the network, such as the network 50 of the system 10 of FIG. 10, for example. The computing device 1500 may communicate with other devices connected to the network to facilitate performance of some of these operations. For example, the computing device 1500 may communicate and coordinate with certain displays to identify elements of a race being displayed by a particular display.

The memory device 614 may store program code and instructions, executable by the processor circuit 610, to control the computing device 1500. The memory device 614 may include random access memory (RAM), which can include non-volatile RAM (NVRAM), magnetic RAM (ARAM), ferroelectric RAM (FeRAM) and other forms as commonly understood in the gaming industry. In some embodiments, the memory device 614 may include read only memory (ROM). In some embodiments, the memory device 614 may include flash memory and/or EEPROM (electrically erasable programmable read only memory). Any other suitable magnetic, optical and/or semiconductor memory may operate in conjunction with the gaming device disclosed herein.

The computing device 1500 may include a communication adapter 626 that enables the computing device 1500 to communicate with remote devices, such as the wireless network, another computing device 1500, and/or a wireless access point, over a wired and/or wireless communication network, such as a local area network (LAN), wide area network (WAN), cellular communication network, or other data communication network, e.g., the network 50 of FIG. 10.

The computing device 1500 may include one or more internal or external communication ports that enable the processor circuit 610 to communicate with and to operate with internal or external peripheral devices, such as a sound card 628 and speakers 630, video controllers 632, a primary display 634, a secondary display 636, input buttons 638 or other devices such as switches, keyboards, pointer devices, and/or keypads, a touch screen controller 640, a card reader 642, currency acceptors and/or dispensers, cameras, sensors such as motion sensors, mass storage devices, microphones, haptic feedback devices, and/or wireless communication devices. In some embodiments, internal or external peripheral devices may communicate with the processor through a universal serial bus (USB) hub (not shown) connected to the processor circuit 610. Although illustrated as being integrated with the computing device 1500, any of the components therein may be external to the computing device 1500 and may be communicatively coupled thereto. Although not illustrated, the computing device 1500 may further include a rechargeable and/or replaceable power device and/or power connection to a main power supply, such as a building power supply.

In some embodiments, the computing device 1500 may include a head mounted device (HMD) and may include optional wearable add-ons that include one or more sensors and/or actuators. Including ones of those discussed herein. The computing device 1500 may be a head-mounted mixed-reality device configured to provide mixed reality elements as part of a real-world scene being viewed by the user wearing the computing device 1500.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks. The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A gaming system comprising:

a processor circuit;

a memory coupled to the processor circuit, the memory comprising machine-readable instructions that, when executed by the processor circuit, cause the processor circuit to:

provide video of a streaming sporting event to a display device of a gaming device;

generate a graphical user interface on the display device that receives an input that corresponds to a wager;

receive, via the graphical user interface, a first wager input that selects a sporting event component of the wager in the streaming sporting event using the video of the streaming sporting event; and receive, via the graphical user interface, a second wager input that identifies an action component of the wager, wherein the action component corresponds to a predicted occurrence that a user wagers will occur relative to the sporting event component in a future portion of the streaming sporting event.

2. The system of claim 1, wherein the processor circuit:

receives, via the gaming device, a confirmation input that corresponds to the wager; and receives the wager that is defined by the first wager input and the second wager input and comprises an outcome that is based on the streaming sporting event responsive to receiving the confirmation input.

3. The system of claim 2, wherein the wager comprises a wager amount, and wherein the processor circuit receives the wager amount before the first and second wager inputs are received.

4. The system of claim 1, wherein the graphical user interface comprises a sporting event participant selection graphic that is movable relative to the streaming sporting event that is displayed and that is movable to select the sporting event component to provide the first wager input, and wherein the sporting event component comprises a player on a team participating in the streaming sporting event.

5. The system of claim 4, wherein the second wager input comprises a directional graphic that defines, via the graphical user interface, a predicted direction of movement of the player during a subsequent play session.

6. The system of claim 4, wherein each team participating in the streaming sporting event comprises a plurality of players, and wherein less than all of the plurality of players are selectable as the sporting event component.

7. The system of claim 1, wherein the graphical user interface comprises a sporting event component graphic that is movable to identify a play position on a sporting event play surface in the streaming sporting event, and wherein the first wager input comprises the sporting event component graphic and the second wager input comprises the play position that is identified by a location of the sporting event component graphic.

8. The system of claim 1, wherein each team participating in the streaming sporting event comprises a plurality of players, wherein the graphical user interface comprises a sporting event component graphic that displays a plurality of plays that define predicted actions of at least a portion of the plurality of players, wherein the first wager input comprise a selection of which team and the second wager input comprises a selection of one of the plurality of plays.

9. The system of claim 1, wherein responsive to receiving the first wager input, the processor circuit graphically generates plurality of action options for selection by the user as the second wager input.

10. The system of claim 1, wherein responsive to receiving the first wager input, the processor circuit graphically generates a wager amount input graphic that is selectable by the user to provide a wager amount input.

11. The system of claim 1, wherein the sporting event component of the first wager input comprises a player on a sports team in the streaming sporting event and the action component of the second wager input comprises a direction of player movement during a subsequent play session.

12. The system of claim 1, wherein the sporting event component of the first wager input comprises a player on a sports team in the streaming sporting event and the action component of the second wager input comprises a prediction of a region of a plurality of regions that the player will advance to.

13. The system of claim 1, wherein the sporting event component of the first wager input comprises team field position and the action component of the second wager input comprises a range of distance that the team field position will change during a given number of subsequent plays.

14. The system of claim 1, wherein receiving the first wager input comprises receiving a graphical pointer input via the graphical user interface, and wherein the first wager input comprises one of a plurality of colors that corresponds to one of a plurality of specific actions that the user wagers that a selected sporting event participant will take.

15. The gaming system of claim 1, wherein the second wager input comprises a telestrator input, and wherein the telestrator input comprises a free-hand sketch that overlays a still or moving image.

16. The gaming system of claim 1, wherein the first wager input comprises a first touch input from the user that selects a player in the streaming sporting event and the second wager input comprises a second touch input from the user that comprises a predicted action that the player in the streaming sporting event will perform.

17. A gaming device comprising:

a display device;

a processor circuit; and a memory coupled to the processor circuit, the memory comprising machine-readable instructions that, when executed by the processor circuit, cause the processor circuit to:

provide, to a user, video of a streaming sporting event to the display device;

generate a graphical user interface on the display device, wherein the graphical user interface receives inputs from the user that correspond to a wager;

receive, via the graphical user interface, a first wager input that selects a sporting event component of the wager in the streaming sporting event; and responsive to receiving the first wager input, generate a plurality of action options that correspond to sporting event outcome options that are selectable by the user as a second wager input.

18. The gaming device of claim 17, wherein the second wager input comprises a telestrator input.

* * * * *